United States Patent [19]

Huntzinger et al.

[11] 4,403,121

[45] Sep. 6, 1983

[54] REMOTE CONTROL UNIT

[75] Inventors: Gerald O. Huntzinger; Raymond O. Butler, Jr.; Lewis R. Hetzler; John Delaplane, all of Anderson, Ind.

[73] Assignee: General Motors Corporation, Detroit, Mich.

[21] Appl. No.: 289,787

[22] Filed: Aug. 3, 1981

[51] Int. Cl.[3] ..... H01H 9/00

[52] U.S. Cl. ..... 200/1 R; 200/5 R; 200/17 R; 335/72; 335/121; 335/184

[58] Field of Search ..... 200/1 R, 4, 5 R, 11 R, 200/17 R, 18, 38 R, 47, 175–180; 335/72, 75, 118, 121, 122, 125, 128, 138, 139, 185, 189

[56] References Cited

U.S. PATENT DOCUMENTS

| | | | |
|---|---|---|---|
| 1,680,416 | 8/1928 | Hodgkins | 335/181 |
| 2,564,246 | 8/1951 | Bourne | 335/181 |
| 2,760,026 | 8/1956 | Horlacher | 335/181 |
| 2,993,963 | 7/1961 | Beardow | 200/30 |
| 3,233,066 | 2/1966 | Stoddard et al. | 200/105 |
| 3,319,019 | 5/1967 | Jullien-Davin | 200/38 R |
| 3,546,401 | 12/1970 | Carlisle | 200/1 R |
| 3,689,820 | 9/1972 | Takegawa | 318/594 |
| 3,743,799 | 7/1973 | Cork et al. | 200/6 B |
| 3,931,483 | 1/1976 | Thompson | 200/1 R |
| 3,944,902 | 3/1976 | Lacorre et al. | 318/593 |
| 3,974,346 | 8/1976 | Keprda | 200/5 B |
| 3,995,206 | 11/1976 | Aronstein et al. | 318/593 |
| 4,021,714 | 5/1977 | Jones et al. | 318/594 |
| 4,264,791 | 4/1981 | Williams | 200/4 |
| 4,281,304 | 7/1981 | Koshman et al. | 335/72 |
| 4,320,266 | 3/1982 | Leiter et al. | 200/4 |

FOREIGN PATENT DOCUMENTS

| | | |
|---|---|---|
| 681221 | 9/1939 | Fed. Rep. of Germany . |
| 1072895 | 6/1960 | Fed. Rep. of Germany . |
| 205062 | 5/1924 | United Kingdom . |
| 1196115 | 6/1970 | United Kingdom . |

*Primary Examiner*—J. R. Scott
*Attorney, Agent, or Firm*—C. R. Meland

[57] ABSTRACT

A plurality of individual electrical load switches each having an operating tab are so mounted and oriented that the operating tabs extend toward a central axis to define a circle substantially normal to the central axis and operate substantially in the direction of the central axis. An operating arm having ends thereof arranged to be brought into register with each operating tab at mutually exclusive angular positions is normally tilt mounted in a first direction upon a rotor that may be positioned in selected ones of a plurality of angular positions by a step motor. Upon one end of the arm being brought into register with a switch operating tab, the arm is tilted in the opposite direction to effect the operation of the operating tab with which the one end thereof is in register to place the corresponding individual electrical load switch in a selected circuit condition.

8 Claims, 13 Drawing Figures

REMOTE CONTROL UNIT

BACKGROUND OF THE INVENTION

This invention is directed to a remote control unit capable of selectively operating each of a plurality of centrally located individual electrical load switches.

Each of the two embodiments disclosed and described in this specification is a remote control unit employing a plurality of conventional individual electrical load switches individually operated by a common switch actuator mechanism that is capable of centrally controlling electrical power to a plurality of electrical circuits and loads. The individual electrical load switches may be simple sliding contact type switches that provide high reliability, high current rating and low voltage drop. Each of these switches may be operated between one circuit condition and another circuit condition by an operating tab that is movable in two directions and are of the type that, once operated, remain in position until the reverse operation is performed. The individual electrical load switches are so mounted and oriented that the several operating tabs extend toward a central axis to define a circle substantially normal to the central axis and are operable in two opposite directions substantially in the direction of the central axis. The switch actuator mechanism involves a step motor driven rotor, a switch actuator arm tiltably mounted upon the rotor and normally tilted in a first direction in which the ends thereof on opposite sides on the axis of pivot are on respective operating sides of the switch operating tabs and having the ends thereof on opposite sides of the axis of pivot circumferentially offset from each other so that each may be brought into register with each switch operating tab at mutually exclusive angular positions and an electrical solenoid coil arranged to effect the tilting of the actuator arm in the opposite direction. With this arrangement, the end of the actuator arm normally tilted away from the rotor may operate any of the switch operating tabs substantially in the direction of the central axis toward the rotor and the other end of the actuator arm normally tilted toward the rotor may operate any of the switch operating tabs substantially in the direction of the central axis away from the rotor. To operate the operating tab of a selected individual electrical load switch in a direction toward the rotor, the end of the actuator arm tilted away from the rotor is brought into register with this operating tab and the solenoid coil is energized to tilt the actuator arm in the opposite direction to operate the operating tab with which it is in register. To operate the operating tab of a selected individual electrical load switch in a direction away from the rotor, the end of the actuator arm tilted toward the rotor is brought into register with this operating tab and the solenoid coil is energized to tilt the actuator arm in the opposite direction to operate the operating tab with which it is in register.

The remote control unit of this invention has the desirable features of (1) a single centrally mounted unit that controls a plurality of switching functions; (2) the load switches have high contact force and good wiping action; (3) all load switches may be identical permitting high volume production; (4) a single switch actuator mechanism controls all of the individual electrical load switches; (5) continuous electrical power is not required to maintain the state of the load switches as is required with electrical relays or power switching transistors; and (6) system power loss does not affect the load switch position.

With automotive applications in particular, a major improvement in the electrical load network may be realized by centrally controlling the several power switching operations near the load or battery at a location ouside the passenger compartment. Such a system eliminates the requirement that the electrical power wiring for the several automotive load circuits such as head lamps, horn, ignition, cranking motors, turn signals and so forth be brought into the dash and instrument panel area. The remote control unit of this invention, therefore, is particularly advantageous with automotive applications in that it may be mounted in a remote location out of the passenger compartment such as the engine compartment. So mounted, this remote control unit significantly reduces wiring congestion in the instrument panel and dash area for the reason that, with its use, most load circuits may be removed from this space.

SUMMARY OF THE INVENTION

It is an object of this invention to provide a remote control unit capable of effecting the operation of each of a plurality of centrally located individual electrical load switches.

It is another object of this invention to provide a remote control unit capable of effecting the operation of each of a plurality of individual electrical load switches having operating tabs extending toward a central axis to define a circle substantially normal to the central axis and movable in the direction of the central axis wherein a rotor rotatable about the central axis and carrying a tiltable arm that extends across the circle in radially overlapping relationship to the operating tabs and having ends circumferentially offset from each other so that the arm registers with each operating tab at two angular positions is rotated to bring one end or the other end of the arm in register with a selected electrical load switch operating tab and the arm is tilted in a direction to operate the tab with which the end of the arm is in register.

It is another object of this invention to provide a remote control unit capable of effecting the operation of each of a plurality of individual electrical load switches having operating tabs extending toward a central axis to define a circle substantially normal to the central axis and movable in the direction of the central axis by rotating an arm that extends across the diameter of the circle and has ends that are circumferentially offset from each other in overlapping relationship to the operating tabs into a position in which one end or the other end of the arm is in register with an operating tab and tilting the arm in a direction in which the operating tab with which one end of the operating arm is in register is operated.

It is another object of this invention to provide a remote control unit capable of effecting the operation of each of a plurality of individual electrical load switches having operating tabs extending toward a central axis to define a circle substantially normal to the central axis and movable in the direction of the central axis by rotating an arm that has ends that overlap the operating tabs and are arranged to be brought into register with each operating tab at mutually exclusive angular positions into a position in which one end of the arm is in register with an operating tab and tilting the arm in the direction in which the operating tab with which the end of the operating arm is in register is operated.

It is another object of this invention to provide a remote control unit capable of effecting the operation of each of a plurality of individual electrical load switches having operating tabs extending toward a central axis to define a circle substantially normal to the central axis and movable in the direction of the central axis by rotating an arm having opposite ends that overlap the operating tabs and are so arranged that one end is in register with an operating tab in each of alternate angular positions and the other end is in register with an operating tab in each of the other alternate angular positions to a position in which one end or the other end of the arm is in register with an operating tab and tilting the arm in the direction in which the operating tab with which one end of the operating arm is in register is operated.

It is another object of this invention to provide a remote control unit capable of effecting the operation of each of a plurality of individual electrical load switches having operating tabs extending toward a central axis to define a circle substantially normal to the central axis and movable in the direction of the central axis by rotating a rotor mounted arm that is normally tilted in a first direction in which the ends thereof are in the operating sides of the operating tabs with the ends being in overlapping relationship with the operating tabs and arranged to be brought into register with each of the operating tabs at mutually exclusive angular positions to a position in which one end or the other end of the arm is in register with an operating tab and tilting the arm in the direction in which the operating tab with which one end of the operating arm is in register is operated.

In accordance with this invention, a remote control unit is provided wherein a plurality of individual electrical switches each having an operating tab are so mounted and so oriented that the operating tabs extend toward and are operable in the direction of a central axis and each operating tab is operated upon the tilting of a rotor mounted tiltable actuator arm having ends that overlap the operating tabs and that are arranged to be brought into register with each operating tab at mutually exclusive angular positions.

For a better understanding of the present invention, together with additional objects, advantages and features thereof, reference is made to the following description and accompanying drawing in which:

DESCRIPTION OF THE PREFERRED EMBODIMENTS

Figure 1:
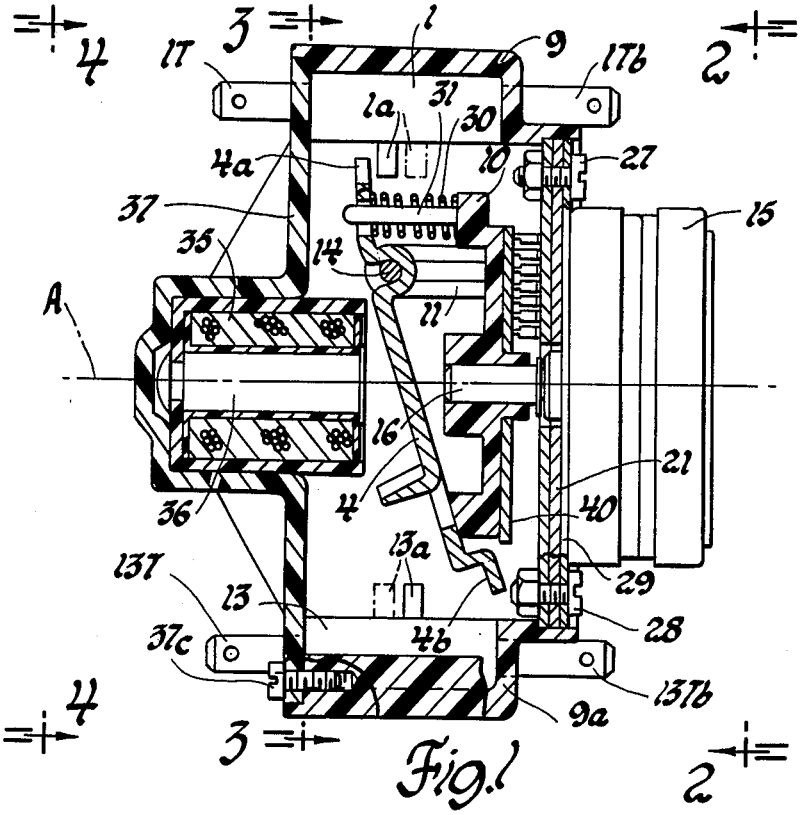
FIG. 1 is an elevation view partially in section of one embodiment of the remote control unit of this invention.

Two embodiments of the remote control unit of this invention are shown and described in this specification. In the drawing, one embodiment is set forth in FIGS. 1-4, inclusive, and another embodiment is set forth in FIGS. 5-13, inclusive. The embodiment set forth in FIGS. 1-4 will initially be considered.

Figure 3:
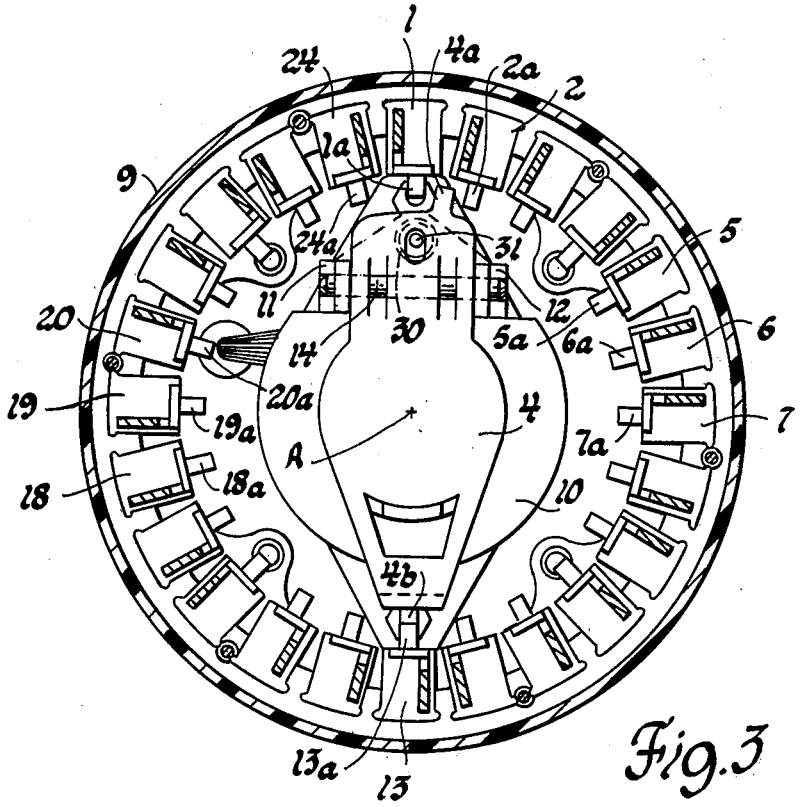
FIG. 3 is a section view of FIG. 1 taken along line 3—3 and looking in the direction of the arrows.

As is best seen in FIG. 3, a substantially cylindrical housing member 9 that may be made of an injection molded plastic material such as glass and mica-filled polyethylene terephthalate marketed by E. I. DuPont de Nemours & Company of Wilmington, Del., under the trade name "Rynite" is designed to securely support a plurality of individual electrical switches in a circumferential arrangement. Although there are twenty-four individual electrical load switches employed in this embodiment, since all of these switches are substantially physically identical, ten are referenced by the reference numerals 1, 2, 5, 6, 7, 13, 18, 19, 20 and 24 in FIG. 3. Each of the individual electrical load switches may be of the conventional sliding contact type having an operating tab that is movable in two opposite directions to establish, respectively, one circuit condition or another circuit condition of the switch. These individual electrical load swtiches are mounted in a circumferential arrangement and are so mounted and oriented that the operating tab of each extends toward a central axis A and is movable in substantially the direction of the central axis A between a common pair of planes substantially normal to the central axis A to establish, respectively, one circuit condition or another circuit condition of the corresponding switch. This is best seen in FIG. 1 in which operating tab 1*a* of switch 1 is shown in solid lines and the operating tab 13*a* of switch 13 is shown in dashed lines in the same first common plane and operating tab 1*a* of switch 1 is shown in dashed lines and operating tab 13*a* of switch 13 is shown in solid lines in the same second common plane. With this arrangement, the individual electrical switch operating tabs extend toward a central axis to define a circle substantially normal to and concentric with the central axis with each of the operating tabs being movable in substantially the the direction of the central axis between a common pair of planes substantially normal to the central axis to establish, respectively, one circuit condition or another circuit condition of the corresponding switch.

Located within the substantially cylindrical volume defined by the inboard face surfaces of the individual electrical switches is a rotor 10 supported for rotation substantially about the central axis A in a plane substantially normal to the central axis A. Rotor 10 may be made of an injection molded Acetal plastic such as that marketed by E. I. DuPont de Nemours & Company of Wilmington, Del. under the trade name "Delrin".

Rotor 10 is arranged to carry a switch actuator arm 4 that extends across the diameter of the circle defined by the individual electrical switch operating tabs and is of such a dimension as to be in radially overlapping relationship to the individual electrical switch operating tabs. Actuator arm 4 is tiltably mounted upon rotor 10 about a shaft 14 that is supported with the axis thereof substantially normal to central axis A by stanchion members 11 and 12 extending from rotor 10 in the direction of central axis A inboard of the circle defined by the operating tabs of the individual electrical switches. With this arrangement, actuator arm 4 is tiltable about an axis substantially normal to central axis A and inboard of the circle defined by the operating tabs of the individual electrical switches.

To position rotor 10 with one end or the other end of actuator arm 4 on opposite sides of the axis of tilt in register with a selected individual electrical switch operating tab, rotor 10 is mounted upon the shaft 16 of a step motor 15 that is selectively operable to position rotor 10 in selected ones of a plurality of angular positions in each of which one of the ends of actuator arm 4 is in register with a selected one of the individual electrical switch operating tabs. In this embodiment, the unit selected for step motor 15 is a commercially available device marketed by North American Phillips Controls Corporation of Cheshire, Conn. under the designation model number K-82701-T1. A bottom plate 21 is secured by any suitable fastening means such as screws 22, 23, 25 and 26, FIG. 2, to accommodating mounting tabs circumferentially located about the bottom of cylindrical housing member 9. Motor 15 may be secured to bottom plate 21 by any suitable fastening device such as bolts 27 and 28 extending through mounting flange 29 and accommodating openings in bottom plate 21.

Actuator arm 4 carried by rotor 10 is of such a dimension in the direction of the diameter of the circle defined by the several individual electrical switch operating tabs that the ends thereof on respective opposite sides of the axis of tilt are in overlapping relationship with all of the individual electrical switch operating tabs. For the reason that will be brought out later in this specification, the overlapping ends of actuator arm 4 are arranged to be in register with each of the individual electrical switch operating tabs at mutually exclusive angular positions by circumferentially offsetting the ends in such a manner that actuator arm 4 is in register with each individual electrical switch operating tab at two angular positions, one for each end. Without intention or inference of a limitation thereto, actuator arm 4 is indicated to have a switch operating projection 4*a* and 4*b* on respective opposite ends that are circumferentially offset from each other. It is to be specifically understood that any other circumferential offset arrangement for the ends of actuator arm 4 on opposite sides of the axis of tilt may be employed without departing from the spirit of the invention. To tilt actuator arm 4 in a first direction in advance of rotor rotation to a first position in which the ends thereof on opposite sides of the axis of pivot normally lie in respective planes substantially parallel to and in bracketing relationship with the previously described common pair of planes in which the individual electrical switch operating tabs lie, a compression spring 30 is located between opposing face surfaces of actuator arm 4 and rotor 10 on the same side of the axis of pivot and is retained by a pin 31 secured to rotor 10. As viewing FIG. 1, under the force of compression spring 30, actuator arm 4 is normally tilted in a counterclockwise direction about the axis of pivot whereby the end of actuator arm 4 to the right of the axis of pivot normally lies in a plane outside of the plane in which the solid line operating tab 1*a* and the dashed line operating tab 13*a* lies and the end of actuator arm 4 to the left of the axis of pivot normally lies in a plane that is outside of the plane in which dashed line operating tab 1*a* and solid line operating tab 13*a* lies and in the opposite direction from that of the plane in which the other end of actuator arm 4 normally lies. With this arrangement and as viewing FIG. 1, therefore, actuator arm 4 is spring force tilted in a first counterclockwise direction about the axis of pivot by compression spring 30 in advance of rotor rotation to a position in which the ends thereof on opposite sides of the axis of pivot are on the operating side of the several individual electrical switch operating tabs.

Figure 4:
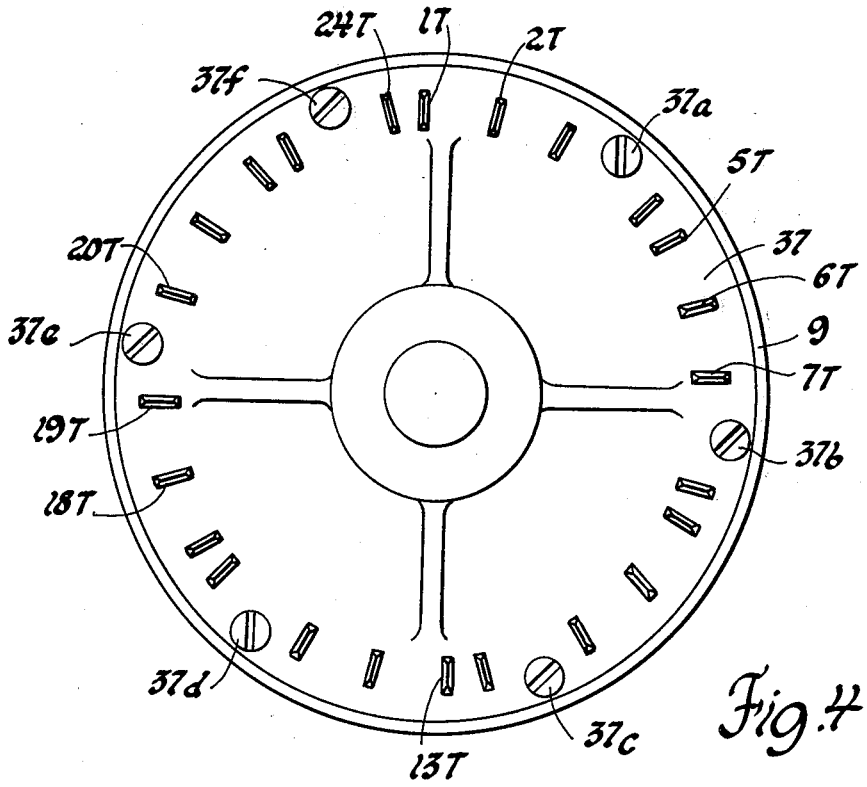
FIG. 4 is a top view of FIG. 1 looking in the direction of the arrow 4—4.

To tilt actuator arm 4 in a second opposite direction against the force of spring 30 when one of the ends thereof is in register with an individual electrical switch operating tab to engage the operating tab with which the one end of the arm is in register to operate the corresponding electrical switch, a solenoid coil 35 having a core 36 of a magnetic material is employed. Upon the energization of solenoid coil 35, actuator arm 4 functions as an armature therefor and is tilted in a second opposite clockwise direction about the axis of pivot. Should end 4*a* of actuator arm 4 be in register with operating tab 1*a* of electrical switch 1 upon the tilt of actuator arm 4 in the clockwise direction under the influence of energized solenoid coil 35, end 4*a* thereof operatively engages operating tab 1*a* and moves this tab substantially in the direction of the central axis A toward rotor 10 from the position shown by solid lines to the position shown by dashed lines to operate electrical switch 1 out of one operating condition and to establish another operating condition. Should end 4*b* of actuator arm 4 be in register with operating tab 13*a* of electrical switch 13 upon the tilt of actuator arm 4 in the clockwise direction under the influence of energized solenoid coil 35, end 4*b* thereof operatively engages operating tab 13*a* and moves this tab substantially in the direction of the central axis A away from rotor 10 from the position shown by solid lines to the position shown by dashed lines to operate switch 13 out of one operating condition and to establish another operating condition. Solenoid coil 35 and its iron solenoid core 36 are supported and retained by a solenoid housing 37 that may be made of an injection molded material the same as that of cylindrical housing member 9. As is best seen in FIG. 4, solenoid housing 37 may be secured to accommodating bosses in housing member 9 by any suitable fastening arrangement such as screws 37*a*, 37*b*, 37*c*, 37*d*, 37*e* and 37*f*.

Figure 2:
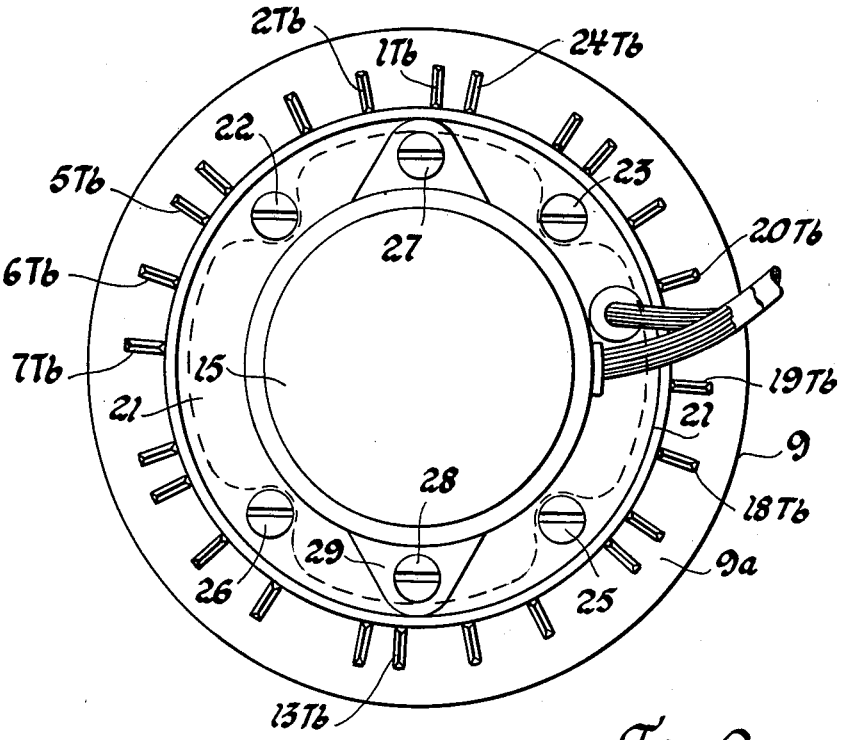
FIG. 2 is a bottom view of FIG. 1 looking in the direction of the arrows 2—2.

To provide for external electrical connections, each of the individual electrical switches may have a spade type terminal extending from each opposite end thereof that are arranged to extend through accommodating openings in solenoid housing 37 and through accommodating openings in an annular shoulder 9*a* formed at one end of housing member 9 as best seen in FIG. 1. In FIG. 4 of the drawing, ten of these terminals corresponding to individual electrical switches 1, 2, 5, 6, 7, 13, 18, 19, 20 and 24 that extend through accommodating slots in solenoid housing 37 are identified by the respective reference numerals 1T, 2T, 5T, 6T, 7T, 13T, 18T, 19T, 20T and 24T. In FIG. 2 of the drawing, ten of these terminals corresponding to individual electrical switches 1, 2, 5, 6, 7, 13, 18, 19, 20 and 24 that extend through accommodating slots in the annular shoulder 9*a* formed at one end of housing member 9 are identified by the respective reference numerals 1Tb, 2Tb, 5Tb, 6Tb, 7Tb, 13Tb, 18Tb, 19Tb, 20Tb and 24Tb.

As there are twenty-four circumferentially arranged individual electrical load switches in this embodiment and since the ends of actuator arm 4 are arranged to be brought into register with each of the individual electrical switch operating tabs at mutually exclusive angular positions, it is necessary that step motor 15 be arranged to position rotor 10 in each of a plurality of angular positions, hereinafter referred to as switch operating positions, of a number equal to twice the number of individual electrical load switches, forty-eight in this embodiment, with each individually electrical switch operating tab and each space between adjacent operating tabs being a switch operating position. With reference to FIG. 3, it will be assumed for purposes of this specification that end 4*a* of actuator arm 4 is the reference end; that operating tab 1*a* of individual electrical switch 1 is switch operating position number one and that the switch operating positions are numbered sequentially from position number one in a clockwise direction. As individual electrical switch operating tab 1*a* of individual electrical switch 1 is in switch operating position number one and end 4*a* of actuator arm 4 is the reference end thereof, rotor 10 is shown in FIG. 3 to be positioned in switch operating position number two in which end 4*a* of actuator arm 4 is located in the space between adjacent individual electrical switch operating tabs 1*a* and 2*a* of respective individual electrical switches 1 and 2 and end 4*b* of actuator arm 4 is located in register with individual electrical switch operating tab 13*a* of individual electrical switch 13. Upon the energization of solenoid coil 35 with rotor 10 positioned in this switch operating position number two, actuator arm 4 is tilted in a clockwise direction about the axis of pivot and end 4*b* thereof engages and operates individual electrical switch operating tab 13*a* of individual electrical switch 13 substantially in the direction of central axis A away from rotor 10 to establish the selected circuit condition of individual electrical switch 13 to which it is operated by end 4*b* of actuator arm 4. As end 4*a* of actuator arm is located in the space between adjacent individual electrical switch operating tabs 1*a* and 2*a* of respective individual electrical switches 1 and 2, end 4*a* does not engage an individual electrical switch operating tab in this switch position.

With the several switch operating positions numbered as hereinabove set forth, each of the several individual electrical switch operating tabs is in an odd numbered switch operating position and each of the several spaces between each adjacent pair of the individual electrical switch operating tabs is in an even numbered switch operating position. To operate any one of the several individual electrical switch operating tabs in a direction toward rotor 10 by end 4*a* of actuator arm 4, rotor 10 is positioned by motor 15 to the odd numbered switch operating position of the operating tab desired to be operated. To operate any one of the several individual electrical switch operating tabs in a direction away from rotor 10 by end 4*b* of actuator arm 4, rotor 10 is positioned by motor 15 in the even numbered switch operating position in which end 4*b* of actuator arm 4 is in register with the operating tab desired to be operated. To illustrate the operation of the remote control unit of this invention, the positioning of rotor 10 to effect the operation of several of the individual electrical switch operating tabs by each end 4*a* and end 4*b* of actuator arm 4 will now be described.

To next position rotor 10 in the switch operating position in which individual electrical switch 7 may be operated to establish the selected circuit condition thereof to which it is operated by end 4*a* of actuator arm 4, rotor 10 is rotated by step motor 15 from switch operating position number two in a clockwise direction through eleven switch operating positions or in a counterclockwise direction through thirty-seven switch operating positions to switch operating position number thirteen in which end 4*a* of actuator arm 4 is in register with individual electrical switch operating tab 7*a* of individual electrical switch 7 and end 4*b* is located in the space between adjacent individual electrical switch operating tabs 18*a* and 19*a* of respective individual electrical switches 18 and 19. Upon the energization of solenoid coil 35 with rotor 10 positioned in this switch operating position number thirteen, actuator arm 4 is tilted in a clockwise direction about the axis of pivot and end 4*a* thereof engages and operates individual electrical switch operating tab 7*a* of individual electrical switch 7 substantially in the direction of central axis A toward rotor 10 to establish the selected circuit condition of individual electrical switch 7 to which it is operated by end 4*a* of actuator arm 4. As end 4*b* of actuator arm 4 is located in the space between adjacent individual electrical switch operating tabs 18*a* and 19*a* of respective individual electrical switches 18 and 19, end 4*b* does not engage an individual electrical switch operating tab in this switch position.

To next position rotor 10 in the switch operating position in which individual electrical switch 18 may be operated to establish the selected circuit condition thereof to which it is operated by end 4*a* of actuator arm 4, rotor 10 is rotated by step motor 15 from switch operating position number thirteen in a clockwise direction through twenty-two switch operating positions or in a counterclockwise direction through twenty-six switch operating positions to switch operating position number thirty-five in which end 4*a* of actuator arm 4 is in register with individual electrical switch operating tab 18*a* of individual electrical switch 18 and end 4*b* is located in the space between adjacent individual electrical switch operating tabs 5*a* and 6*a* of respective individual electrical switches 5 and 6. Upon the energization of solenoid coil 35 with rotor 10 positioned in this switch operating position number thirty-five, actuator arm 4 is tilted in a clockwise direction about the axis of pivot and end 4*a* thereof engages and operates individual electrical switch operating tab 18*a* of individual electrical switch 18 substantially in the direction of central axis A toward rotor 10 to establish the selected circuit condition of individual electrical switch 18 to which it is operated by end 4*a* of actuator arm 4. As end 4*b* of actuator arm 4 is located in the space between adjacent individual electrical switch operating tabs 5*a* and 6*a* of respective individual electrical switches 5 and 6, end 4*b* does not engage an individual electrical switch operating tab in this switch position.

To next position rotor 10 in the switch operating position in which individual electrical switch 13 may be operated to establish the selected circuit condition thereof to which it is operated by end 4*a* of actuator arm 4, rotor 10 is rotated by step motor 15 from switch operating position number thirty-five in a clockwise direction through thirty-eight switch operating positions or in a counterclockwise direction through ten switch operating positions to switch operating position number twenty-five in which end 4*a* of actuator arm 4 is in register with individual electrical switch operating tab 13*a* of individual electrical switch 13 and end 4*b* is located in the space between adjacent individual electrical switch operating tabs 24*a* and 1*a* of respective individual electrical switches 24 and 1. Upon the energization of solenoid coil 35 with rotor 10 positioned in this switch operating position number twenty-five, actuator arm 4 is tilted in a clockwise direction about the axis of pivot and end 4*a* thereof engages and operates individual electrical switch operating tab 13*a* of individual electrical switch 13 substantially in the direction of central axis A toward rotor 10 to establish the selected circuit condition of individual electrical switch 13 to which it is operated by end 4*a* of actuator arm 4. As end 4*b* of actuator arm 4 is located in the space between adjacent individual electrical switch operating tabs 24*a* and 1*a* of respective individual electrical switches 24 and 1, end 4*b* does not engage an individual electrical switch operating tab in this switch position.

To next position rotor 10 in the switch operating position in which individual electrical switch 7 may be operated to establish the selected circuit condition thereof to which it is operated by end 4*b* of actuator arm 4, rotor 10 is rotated by step motor 15 from switch operating position number twenty-five in a clockwise direction through thirteen switch operating positions or in a counterclockwise direction through thirty-five switch operating positions to switch operating position number thirty-eight in which end 4*b* of actuator arm 4 is in register with individual electrical switch operating tab 7*a* of individual electrical switch 7 and end 4*a* is located in the space between adjacent individual electrical switch operating tabs 19*a* and 20*a* of respective individual electrical switches 19 and 20. Upon the energization of solenoid coil 35 with rotor 10 positioned in this switch operating position number thirty-eight, actuator arm 4 is tilted in a clockwise direction about the axis of pivot and end 4*b* thereof engages and operates individual electrical switch operating tab 7*a* of individual electrical switch 7 substantially in the direction of central axis A away from rotor 10 to establish the selected circuit condition of individual electrical switch 7 to which it is operated by end 4*b* of actuator arm 4. As end 4*a* of actuator arm 4 is located in the space between adjacent individual electrical switch operating tabs 19*a* and 20*a* of respective individual electrical switches 19 and 20, end 4*a* does not engage an individual electrical switch operating tab in this switch position.

To next position rotor 10 in the switch operating position in which individual electrical switch 18 may be operated to establish the selected circuit condition thereof to which it is operated by end 4*b* of actuator arm 4, rotor 10 is rotated by step motor 15 from switch operating position number thirty-eight in a clockwise direction throught twenty-two switch operating positions or in a counterclockwise direction through twenty-six switch operating positions to switch operating position number twelve in which end 4*b* of actuator arm 4 is in register with individual electrical switch operating tab 18*a* of individual electrical switch 18 and end 4*a* is located in the space between adjacent individual electrical switch operating tabs 6*a* and 7*a* of respective individual electrical switches 6 and 7. Upon the energization of solenoid coil 35 with rotor 10 positioned in this switch operating position number twelve, actuator arm 4 is tilted in a clockwise direction about the axis of pivot and end 4*b* thereof engages and operates individual electrical switch operating tab 18*a* of individual electrical switch 18 substantially in the direction of central axis A away from rotor 10 to establish the selected circuit condition of individual electrical switch 18 to which it is operated by end 4*b* of actuator arm 4. As end 4*a* of actuator arm 4 is located in the space between adjacent individual electrical switch operating tabs 6*a* and 7*a* of respective individual electrical switches 6 and 7, end 4*a* does not engage an individual electrical switch operating tab in this switch position.

From this description, it may be noted that (1) end 4*a* of actuator arm 4 is in register with one individual electrical switch operating tab in each of the odd numbered switch operating positions; (2) end 4*b* of actuator arm 4 is in register with one of the individual electrical switch operating tabs in each of the even numbered switch operating positions; and (3) that, depending upon the switch operating position in which rotor 10 is positioned and the next selected switch operating position to which it is to be rotated, there may be a fewer number of switch operating positions to be traversed by clockwise rotor rotation in some instances or by counterclockwise rotor rotation in other instances. Therefore, actuator arm 4 is so arranged that one of the ends thereof is in register with one individual electrical switch operating tab in each of alternate ones of the switch operating positions and the other end thereof is in register with one individual electrical switch operating tab in each of the other alternate ones of the switch operating positions. To save time, it is desirable that the fewer number of switch operating positions be traversed during each repositioning of rotor 10. Therefore, motor 15 is preferably arranged to be selectively operable to rotate rotor 10 in either direction through a succession of discrete angular or switch operating positions.

Ideally, step motor 15 is digitally controlled by a microprocessor unit such as the MC6802 microprocessor unit marketed by Motorola Semiconductor Products, Inc. of Phoenix, Ariz. The control of the remote control unit of this invention will be described later in this specification with regard to the embodiment of FIGS. 5–13.

To provide an associated microprocessor unit with the switch operating position in which rotor 10 is positioned, a code wheel 40 may be secured to rotor 10, preferably upon the side thereof opposite that upon which actuator arm 4 is mounted. In a manner well known in the art, code wheel 40 is arranged to produce a unique digital signal representation for each of the switch operating positions. This code wheel 40 and the manner in which the digital signal representations are produced thereby will be described in detail later in this specification with regard to the embodiment set forth in FIGS. 5–13, inclusive.

Of the two embodiments of the remote control unit of this invention that are shown and described in this specification, the embodiment set forth in FIGS. 5–13, inclusive, will now be considered.

Figure 5:
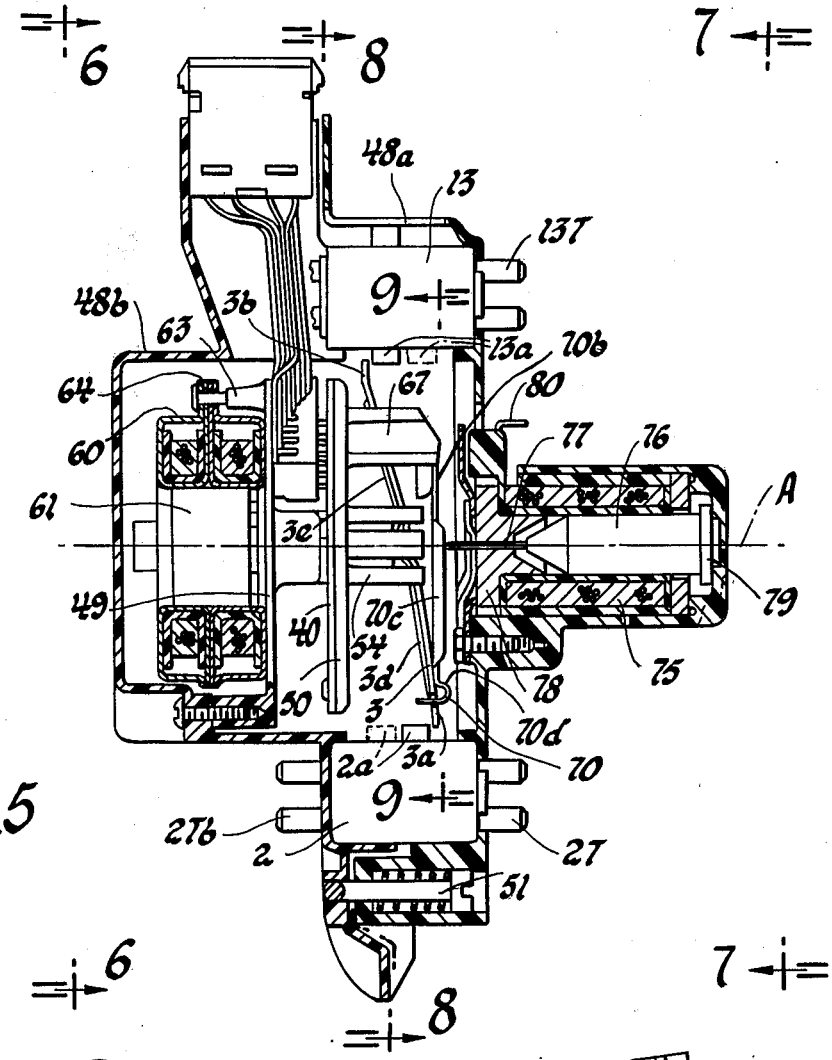
FIG. 5 is an elevation view partially in section of a second embodiment of the remote control unit of this invention.
Figure 8:
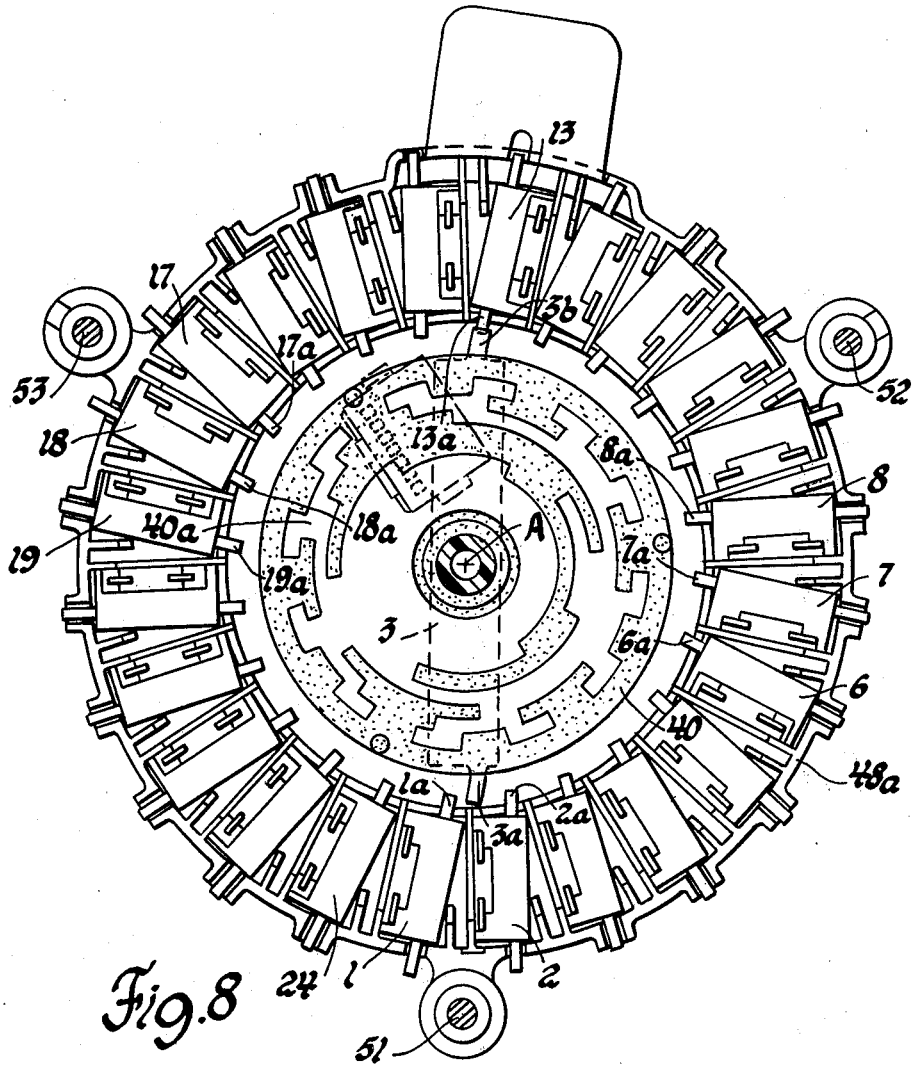
FIG. 8 is a section view of FIG. 5 taken along lines 8—8 and looking in the direction of the arrows.
Figure 9:
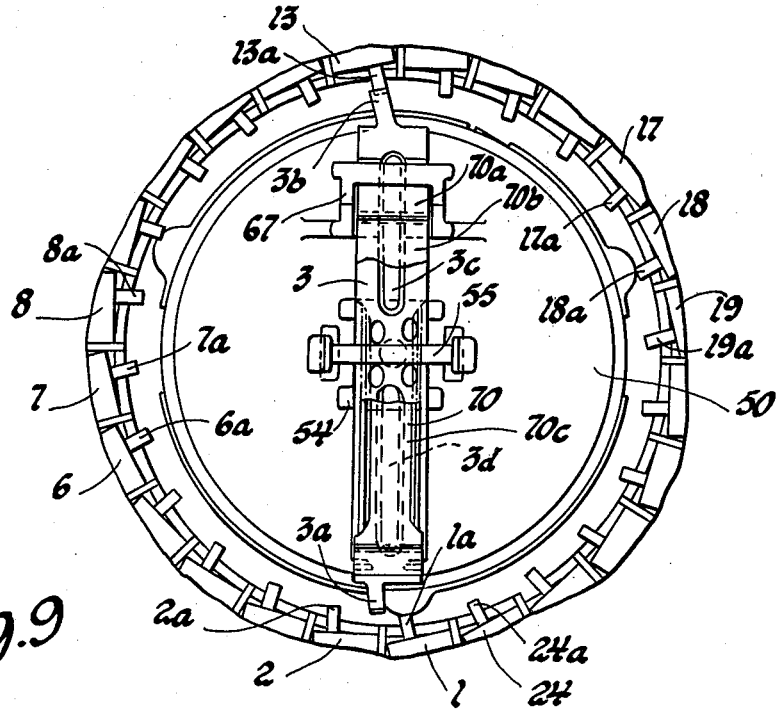
FIG. 9 is a partial section view of FIG. 5 taken along lines 9—9 and looking in the direction of the arrows.

As is best seen in FIG. 5, a two-part housing 48*a* and 48*b* is designed to securely support a plurality of individual electrical switches in a circumferential arrangement. Both portions 48*a* and 48*b* may be made of an injection molded plastic material such as glass and mica-filled polyethylene terephthalate marketed by E. I. DuPont de Nemours & Co. of Wilmington, Del. under the trade name "Rynite". The two portions 48*a* and 48*b* of the housing may be secured together by any suitable fastening arrangement such as spring latches 51, 52 and 53. Each of the individual electrical load switches may be of the conventional sliding contact type having an operating tab that is movable in two opposite directions to establish, respectively, one circuit condition or another circuit condition of the switch. Although there are twenty-four individual electrical load switches employed in this embodiment, since all of these switches are substantially physically identical, ten are referenced by the reference numerals 1, 2, 6, 7, 8, 13, 17, 18, 19 and 24 as is best seen in FIGS. 8 and 9. These twenty-four individual electrical load switches are so mounted and oriented that the operating tab of each extends toward a central axis A to define a circle substantially normal to and concentric with the central axis A and is movable substantially in the direction of central axis A between a common pair of planes substantially normal to central axis A to establish, respectively, one circuit condition or another circuit condition of the corresponding switch. This is best seen in FIG. 5 in which operating tab 13*a* of switch 13 is shown in solid lines and operating tab 2*a* of switch 2 is shown in dashed lines in the same first common plane and operating tab 13*a* of switch 13 is shown in dashed lines and operating tab 2*a* of switch 2 is shown in solid lines in the same second common plane. Therefore, the individual electrical switch operating tabs are movable substantially in the direction of central axis A between a common pair of planes substantially normal to central axis A.

Located within the substantially cylindrical volume defined by the inboard face surfaces of the individual electrical switches is a rotor 50 supported for rotation substantially about central axis A in a plane substantially normal to central axis A by a support member 49. Support member 49 and rotor 50 may be made of an injection molded Acetal plastic such as that marketed by E. I. DuPont de Nemours & Co. of Wilmington, Del. under the trade name "Delrin".

Figure 10:
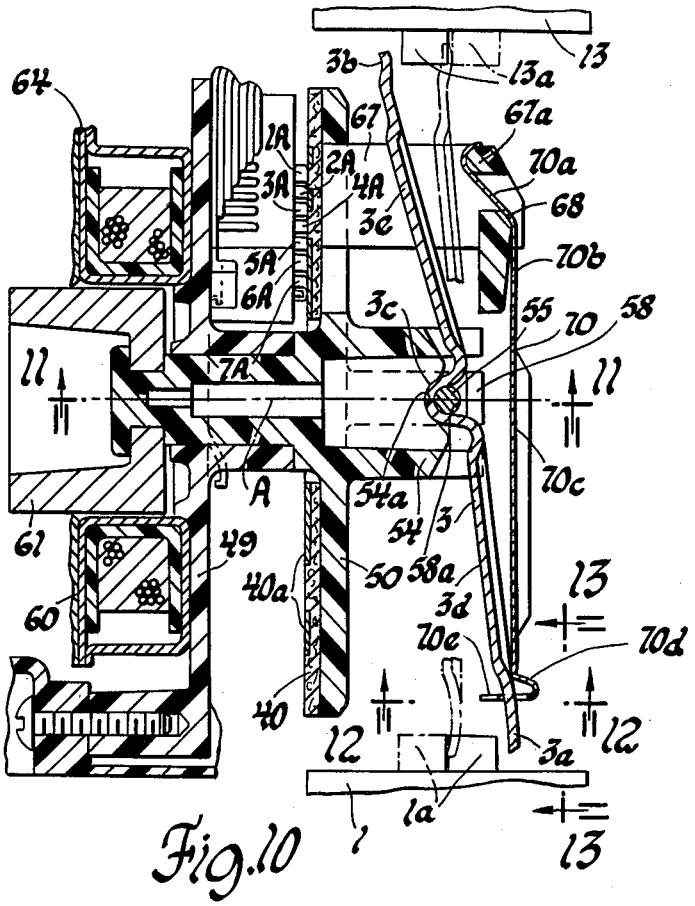
FIG. 10 is an elevation view in section of the switch actuator portion of FIG. 5.
Figure 11:
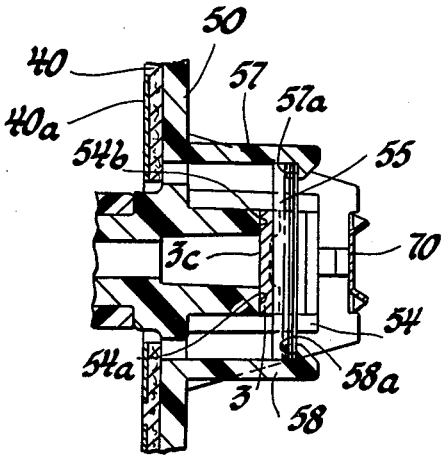
FIG. 11 is a partial section view of FIG. 10 taken along line 11—11 and lookling in the direction of the arrows.

Rotor 50 is arranged to carry a switch actuator arm 3 that extends across the diameter of the circle defined by the individual electrical switch operating tabs and is of such a dimension as to be in radially overlapping relationship to the individual electrical switch operating tabs. To tiltably mount actuator arm 3 about an axis of tilt substantially normal to central axis A and inboard of the circle defined by the individual electrical switch operating tabs, a stanchion 54 carried by rotor 50 is arranged to provide a journal bearing for actuator arm 3 that is maintained in position by a retaining pin 55 as is best seen in FIGS. 10 and 11. Stanchion 54 is provided with two arcuate bearing surfaces 54*a* and 54*b* that are formed to accommodate the arcuate journal bearing accommodating surface 3*c* of actuator arm 3. Stanchion 54 is substantially centered about and extends substantially in the direction of central axis A and is arranged to provide a journal bearing for actuator arm 3 and to support retaining pin 55 in such a manner that the axis of tilt of actuator arm 3 is substantially normal to and substantially intersects central axis A at a location displaced from rotor 50. A pair of flexible retaining pin accommodating members 57 and 58 also carried by rotor 50 extend substantially in the direction of central axis A on opposite sides of stanchion 54 with the respective center lines thereof being aligned with each other along an axis that substantially intersects central axis A. Each of retaining pin accommodating members 57 and 58 has a respective shoulder 57*a* and 58*a* that extends toward central axis A at a location to engage respective ends of retaining pin 55. As retaining pin accommodating members 57 and 58 are flexible, snap-in assembly of retaining pin 55 is provided thereby.

To position rotor 50 with one end or the other end of actuator arm 3 on opposite sides of the axis of tilt in register with a selected individual electrical switch operating tab, rotor 50 is connected to the rotor 61 of a step motor 60 that is selectively operable to position rotor 50 in selected ones of a plurality of angular positions in each of which one of the ends of actuator arm 3 is in register with a selected one of the individual electrical switch operating tabs. In this embodiment, the unit selected for step motor 60 is the functional equivalent of a commercially available device marketed by North American Phillips Controls Corporation of Cheshire, Conn. under the designation model number K-82701-T1. Motor 60 may be secured to support member 49 by any suitable fastening arrangement such as a group of tabs, one of which is referenced by the numeral 63, FIG. 5, extending from support member 49 through accommodating openings in motor flange 64.

Actuator arm 3 carried by rotor 50 is an elongated unitary member of a rigid material adapted for tiltable mounting on a journal bearing that is characterized by an arcuate journal bearing accommodating surface 3*c* extending across the shorter axis thereof. To provide rigidity to actuator arm 3, there is an elongated indentation 3*d* and 3*e* on respective opposite sides of the bearing accommodating surface 3*c*. Actuator arm 3 is of such a dimension in the direction of the diameter of the circle defined by the several individual electrical switch operating tabs that the ends thereof on respective opposite sides of the axis of tilt are in overlapping relationship with all of the individual electrical switch operating tabs. For the reason that will be brought out later in this specification, the overlapping ends of actuator arm 3 are arranged to be in register with each of the individual electrical switch operating tabs at mutually exclusive angular positions by circumferentially offsetting the ends in such a manner that actuator arm 3 is in register with each individual electrical switch operating tab at two angular positions, one for each end. Without intention or inference of limitation thereto, actuator arm 3 is indicated to have a switch operating projection 3*a* and 3*b* on respective opposite ends that are circumferentially offset from each other. It is to be specifically understood that any other circumferential offset arrangement for the ends of actuator arm 3 on opposite sides of the axis of tilt may be employed without departing from the spirit of the invention.

Figure 13:
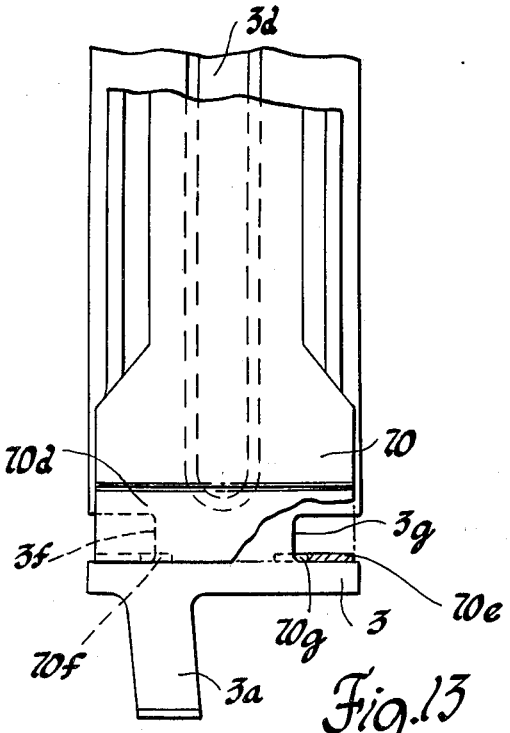
FIG. 13 is a top view partially in break away and partially in section of the portion of FIG. 10 between lines 13—13 and looking in the direction of the arrows.
Figure 12:
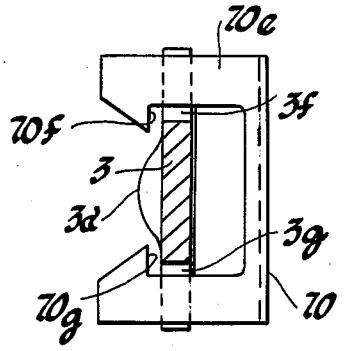
FIG. 12 is a section view of FIG. 10 taken along line 12—12 and looking in the direction of the arrows.

To tilt actuator arm 3 in a first direction in advance of rotor rotation to a first position in which the ends thereof on opposite sides of the axis of tilt normally lie in respective planes substantially parallel to and in bracketing relationship with the previously described common pair of planes in which the individual electrical switch operating tabs lie, a spring 70 is provided. Spring 70 is an elongated unitary spring of a flat spring material characterized by a reverse double arc portion 70*a* at one extremity thereof, a contiguous flat cantilevered section 70*b*, a contiguous intermediate section 70*c* having the parallel edges thereof extending angularly therefrom and a contiguous second reverse double arc section 70*d* at the opposite extremity thereof. The second reverse double arc section 70*d* is formed to provide a terminating portion 70*e* that intersects the plane of the intermediate section 70*c* and has two spaced shoulders 70*f* and 70*g* lying in the same plane and extending toward the center line thereof as is best seen in FIG. 12. As is best seen in FIGS. 9 and 13, the shoulders 70*f* and 70*g* of terminating portion 70*e* of spring 70 engage accommodating notches 3*f* and 3*g* of actuator arm 3.

To accommodate spring 70, rotor 50 carries another support arrangement such as stanchion 67 that extends substantially in the direction of central axis A and is radially displaced from stanchion 54. Stanchion 67 is arranged to provide a fulcrum 68 for the first reverse double arc portion 70*a* of spring 70 having an axis substantially parallel to and radially displaced from the axis of tilt of actuator arm 3 and lies in a plane displaced therefrom substantially in the direction of central axis A away from rotor 50. Upon the assembly of spring 70, one of the arcs of the reverse double arc portion 70*a* is retained by a member 67*a* formed as a portion of stanchion 67 that has an axis substantially parallel to and radially displaced from that of the fulcrum 68 and lies in a plane displaced therefrom substantially in the direction of central axis A toward rotor 50; the other of the arcs of reverse double arc portion 70*a* is accommodated by fulcrum 68 and the shoulders 70*f* and 70*g* of terminating portion 70*e* engaged the respective notches 3*f* and 3*g* of actuator arm 3. With this arrangement, the normal force of spring 70 is in a counterclockwise direction about fulcrum 68; consequently as viewing FIG. 10, actuator arm 3 is spring force tilted in advance of rotor rotation in a first counterclockwise direction about the axis of tilt by spring 70 to a position in which the ends thereof on opposite sides of the axis of pivot are on the operating side of the several individual electrical switch operating tabs.

To tilt actuator arm 3 in a second opposite direction against the force of spring 70 when one of the ends thereof is in register with an individual electrical switch operating tab to engage the operating tab with which the one end of actuator arm 3 is in register to operate the corresponding electrical switch, a solenoid coil 75 having an armature 76 of a magnetic material is employed. Armature 76 may be of a circular cross section having a tapered portion reducing down to an actuating rod 77 that passes through a guide 78 and is in operating engagement with portion 70*c* of spring 70. To reduce noise, a cap 79 of rubber or any other suitable sound deadening material may be installed over the end of armature 76 opposite operating rod 77. Electrical power may be supplied to solenoid coil 75 through input terminals 80 and 81. Solenoid coil 75 may be 440 turns of number 24 copper wire that is so wound that, upon the energization thereof, armature 76 is activated in a direction toward spring 70. Upon the energization of solenoid coil 75, armature 76 is activated in a direction toward spring 70 to tilt actuator arm 3 in a second opposite clockwise direction about the axis of pivot. Referring to FIG. 5, should end 3*b* of actuator arm 3 be in register with operating tab 13*a* of electrical switch 13 upon the tilt of actuator arm 3 in a clockwise direction under the influence of energized solenoid coil 75, end 3*b* thereof operatively engages operating tab 13*a* and moves this tab substantially in the direction of central axis A away from rotor 50 from the position shown by solid lines to the position shown by dashed lines to operate electrical switch 13 out of one operating condition and to establish another operating condition. Should end 3*a* of actuator arm 3 be in register with operating tab 2*a* of electrical switch 2 upon the tilt of actuator arm 3 in a clockwise direction under the influence of energized solenoid coil 75, end 3*a* thereof operatively engages operating tab 2*a* and moves this tab substantially in the direction of central axis A toward rotor 50 from the position shown by solid lines to the position shown by dashed lines to operate switch 2 out of one operating condition and to establish another operating condition.

Figure 6:
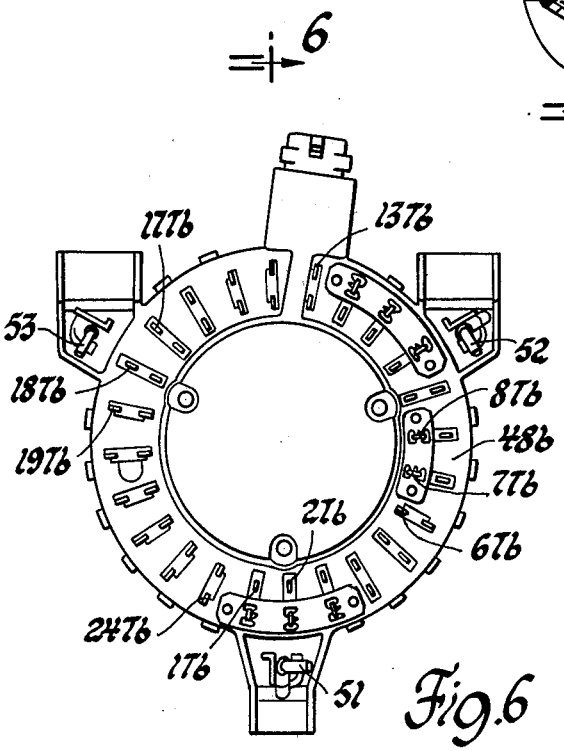
FIG. 6 is a bottom view of FIG. 5 looking in the direction of the arrows 6—6.
Figure 7:
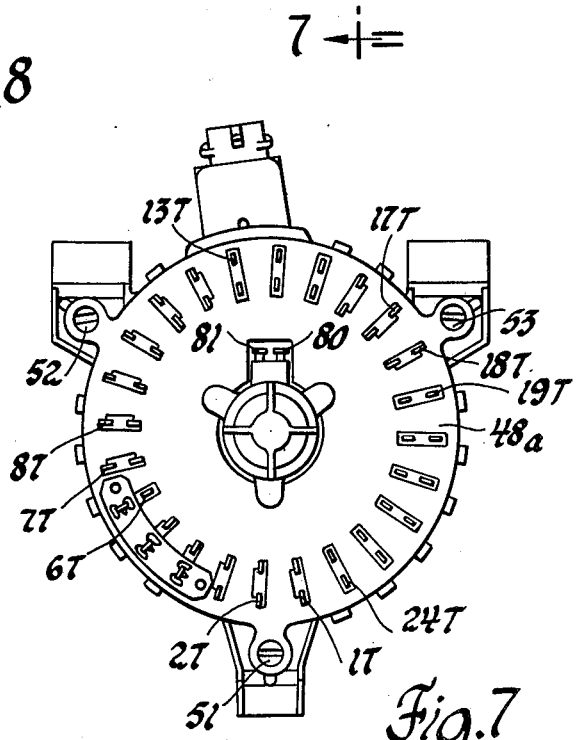
FIG. 7 is a top view of FIG. 5 looking in the direction of the arrows 7—7.

To provide for external electrical connections, each of the individual electrical switches may have two spade-type terminals extending from each opposite end thereof that are arranged to extend through accommodating openings in top portion 48*a* and through accommodating openings in the bottom portion 48*b* of the housing as is best seen in FIGS. 6 and 7. In FIG. 7 of the drawing, ten of these terminal pairs corresponding to individual electrical switches 1, 2, 6, 7, 8, 13, 17, 18, 19 and 24 that extend through accommodating slots in housing portion 48*a* are identified by the respective reference numerals 1T, 2T, 6T, 7T, 8T, 13T, 17T, 18T, 19T and 24T. In FIG. 6 of the drawing, ten of these terminal pairs corresponding to individual electrical switches 1, 2, 5, 6, 7, 13, 17, 18, 19 and 24 that extend through accommodating slots in housing portion 48*b* are identified by respective reference numerals 1Tb, 2Tb, 6Tb, 7Tb, 8Tb, 13Tb, 17Tb, 18Tb, 19Tb and 24Tb.

As there are twenty-four circumferentially arranged individual electrical load switches in this embodiment and since the ends of actuator arm 3 are arranged to be brought into register with each of the individual electrical switch operating tabs at mutually exclusive angular positions, it is necessary that step motor 60 be arranged to position rotor 50 in each of a plurality of angular positions, hereinafter referred to as switch operating positions, of a number equal to twice the number of individual electrical load switches, forty-eight in this embodiment, with each individual electrical switch operating tab and each space between adjacent operating tabs being a switch operating position. With reference to FIG. 9, it will be assumed for purposes of this specification that end 3*a* of actuator arm 3 is the reference end; that operating tab 1*a* of individual electrical switch 1 is switch operating position number one and that the switch operating positions are numbered sequentially from position number one in a clockwise direction. As individual electrical switch operating tab 1*a* of individual electrical switch 1 is in switch operating position number one and end 3*a* of actuator arm 3 is the reference end thereof, rotor 50 is shown in FIG. 9 to be positioned in switch operating position number two in which end 3*a* of actuator arm 3 is located in the space between adjacent individual electrical switch operating tabs 1*a* and 2*a* of respective individual electrical switches 1 and 2 and end 3*b* of actuator arm 3 is located in register with individual electrical switch operating tab 13*a* of individual electrical switch 13. Upon the energization of solenoid coil 75 with rotor 50 positioned in this switch operating position number two, actuator arm 3 is tilted in a clockwise direction about the axis of pivot and end 3*b* thereof engages and operates individual electrical switch operating tab 13*a* of individual electrical switch 13 substantially in the direction of central axis A away from rotor 50 to establish the selected circuit condition of individual electrical switch 13 to which it is operated by end 3*b* of actuator arm 3. As end 3*a* of actuator arm 3 is located in the space between adjacent individual electrical switch operating tabs 1*a* and 2*a* of respective individual electrical switches 1 and 2, end 3a does not engage an individual electrical switch operating tab in this switch position.

With the several switch operating positions numbered as hereinabove set forth, each of the several individual electrical switch operating tabs is in an odd numbered switch operating position and each of the several spaces between each adjacent pair of individual electrical switch operating tabs is in an even numbered switch operating position. To operate any one of the several individual electrical switch operating tabs in a direction toward rotor 50 by end 3a of actuator arm 3, rotor 50 is positioned by motor 60 to the odd numbered switch operating position of the operating tab desire to be operated. To operate any one of the several individual electrical switch operating tabs in a direction away from rotor 50 by end 3b of actuator arm 3, rotor 50 is positioned by motor 60 to the even numbered switch operating position in which end 3b of actuator arm 3 is in register with the operating tab desired to be operated. To illustrate the operation of the remote control unit of this invention, the positioning of rotor 50 to effect the operation of several of the individual electrical switch operating tabs by each end 3a and end 3b of actuator arm 3 will now be described.

To next position rotor 50 in the switch operating position in which individual electrical switch 19 may be operated to establish the selected circuit condition thereof to which it is operated by end 3a of actuator arm 3, rotor 50 is rotated by step motor 60 from switch operating position number two in a clockwise direction through thirty-five switch operating positions or in a counterclockwise direction through thirteen switch operating positions to switch operating position number thirty-seven in which end 3a of actuator arm 3 is in register with individual electrical switch operating tab 19a of individual electrical switch 19 and end 3b is located in the space between adjacent individual electrical switch operating tabs 6a and 7a of respective individual electrical switches 6 and 7. Upon the energization of solenoid coil 75 with rotor 50 positioned in this switch operating position number thirty-seven, actuator arm 3 is tilted in a clockwise direction about the axis of pivot and end 3a thereof engages and operates individual electrical switch operating tab 19a of individual electrical switch 19 substantially in the direction of central axis A toward rotor 50 to establish the selected circuit condition of individual electrical switch 19 to which it is operated by end 3a of actuator arm 3. As end 3b of actuator arm 3 is located in the space between adjacent individual electrical switch operating tabs 6a and 7a of respective individual electrical switches 6 and 7, end 3b does not engage an individual electrical switch operating tab in this switch position.

To next position rotor 50 in the switch operating position in which individual electrical switch 6 may be operated to establish the selected circuit condition thereof to which it is operated by end 3a of actuator arm 3, rotor 50 is rotated by step motor 60 from switch operating position number thirty-seven in a clockwise direction through twenty-two switch operating positions or in a counterclockwise direction through twenty-six switch operating positions to switch operating position number eleven in which end 3a of actuator arm 3 is in register with individual electrical switch operating tab 6a of individual electrical switch 6 and end 3b is located in the space between adjacent individual electrical switch operating tabs 17a and 18a of respective individual electrical switches 17 and 18. Upon the energization of solenoid coil 75 with rotor 50 positioned in this switch operating position number eleven, actuator arm 3 is tilted in a clockwise direction about the axis of pivot and end 3a thereof engages and operates individual electrical switch operating tab 6a of individual electrical switch 6 substantially in the direction of central axis A toward rotor 50 to establish the selected circuit condition of individual electrical switch 6 to which it is operated by end 3a of actuator arm 3. As end 3b of actuator arm 3 is located in the space between adjacent individual electrical switch operating tabs 17a and 18a of respective individual electrical switches 17 and 18, end 3b does not engage an individual electrical switch operating tab in this switch position.

To next position rotor 50 in the switch operating position in which individual electrical switch 13 may be operated to establish the selected circuit condition thereof to which it is operated by end 3a of actuator arm 3, rotor 50 is rotated by step motor 60 from switch operating position number eleven in a clockwise direction through fourteen switch operating positions or in a counterclockwise direction through thirty-four switch operating positions to switch operating position number twenty-five in which end 3a of actuator arm 3 is in register with individual electrical switch operating tab 13a of individual electrical switch 13 and end 3b is located in the space between adjacent individual electrical switch operating tabs 1a and 24a of respective individual electrical switches 1 and 24. Upon the energization of solenoid coil 75 with rotor 50 positioned in this switch operating position number twenty-five, actuator arm 3 is tilted in a clockwise direction about the axis of pivot and end 3a thereof engages and operates individual electrical switch operating tab 13a of individual electrical switch 13 substantially in the direction of central axis A toward rotor 50 to establish the selected circuit condition of individual electrical switch 13 to which it is operated by end 3a of actuator arm 3. As end 3b of actuator arm 3 is located in the space between adjacent individual electrical switch operating tabs 1a and 24a of respective individual electrical switches 1 and 24, end 3b does not engage an individual electrical switch operating tab in this switch position.

To next position rotor 50 in the switch operating position in which individual electrical switch 19 may be operated to establish the selected circuit condition thereof to which it is operated by end 3b of actuator arm 3, rotor 50 is rotated by step motor 60 from switch operating position number twenty-five in a clockwise direction through thirty-seven switch operating positions or in a counterclockwise direction through eleven switch operating positions to switch operating position number fourteen in which end 3b of actuator arm 3 is in register with individual electrical switch operating tab 19a of individual electrical switch 19 and end 3a is located in the space between adjacent individual electrical switch operatings tabs 7a and 8a of respective individual electrical switches 7 and 8. Upon the energization of solenoid coil 75 with rotor 50 positioned in this switch operating position number fourteen, actuator arm 3 is tilted in a clockwise direction about the axis of pivot and end 3b thereof engages and operates individual electrical switch operating tab 19a of individual electrical switch 19 substantially in the direction of central axis A away from rotor 50 to establish the selected circuit condition of individual electrical switch 19 to which it is operated by end 3b of actuator arm 3. As end 3a of actuator arm 3 is located in the space between adjacent individual electrical switch operating tabs 7a and 8a of respective individual electrical switches 7 and 8, end 3a does not engage an individual electrical switch operating tab in this switch position.

To next position rotor 50 in the switch operating position in which individual electrical switch 6 may be operated to establish the selected circuit condition thereof to which it is operated by end 3b of actuator arm 3, rotor 50 is rotated by step motor 60 from switch operating position number fourteen in a clockwise direction through twenty-two switch operating positions or in a counterclockwise direction throught twenty-six switch operating positions to switch operating position number thirty-six in which end 3b of actuator arm 3 is in register with individual electrical switch operating tab 6a of individual electrical switch 6 and end 3a is located in the space between adjacent individual electrical switch operating tabs 18a and 19a of respective individual electrical switches 18 and 19. Upon the energization of solenoid coil 75 with rotor 50 positioned in this switch operating position number thirty-six, actuator arm 3 is tilted in a clockwise direction about the axis of pivot and end 3b thereof engages and operates individual electrical switch operating tab 6a of individual electrical switch 6 substantially in the direction of central axis A away from rotor 50 to establish the selected circuit condition of individual electrical switch 6 to which it is operated by end 3b of actuator arm 3. As end 3a of actuator arm 3 is located in the space between adjacent individual electrical switch operating tabs 18a and 19a of respective individual electrical switches 18 and 19, end 3a does not engage an individual electrical switch operating tab in this switch position.

From this description, it may be noted that (1) end 3a of actuator arm 3 is in register with one individual electrical switch operating tab in each of the odd numbered switch operating positions; (2) end 3b of actuator arm 3 is in register with one of the individual electrical switch operating tabs in each of the even numbered switch operating positions; and (3) that, depending upon the switch operating position in which rotor 50 is positioned and the next selected switch operating position to which it is to be rotated, there may be a fewer number of switch operating positions to be traversed by clockwise rotor rotation in some instances or by counterclockwise rotor rotation in other instances. Therefore, actuator arm 3 is so located that one of the ends thereof is in register with one individual electrical switch operating tab in each of alternate ones of the switch operating position and the other end thereof is in register with one individual electrical switch operating tab in each of the other alternate ones of the switch operating positions. To save time, it is desirable that the fewer number of switch operating positions be traversed during each repositioning of rotor 50. Therefore, motor 60 is preferably arranged to be selectively operable to rotate rotor 50 in either direction through a succession of discrete angular or switch operating positions.

Ideally, step motor 60 is digitally controlled by a microprocessor unit such as the MC6802 microprocessor unit marketed by Motorola Semiconductor Products, Inc. of Phoenix, Ariz. In a manner well known in the electronic data processor art, this unit may be programmed to position rotor 50 in response to digital command signals that may be produced by momentary contact electrical switches arranged for manual operation to select each of several different electrical circuit control functions.

As with the embodiment of the remote control unit of this invention previously described in this specification with regard to FIGS. 1-4, inclusive, rotor 50 of this embodiment carries a code wheel 40 preferably on the side facing motor 60 as is best seen in FIGS. 5, 8 and 10. Code wheel 40 may be a disc of an insulating material that is arranged to support a conductive pattern 40a in a manner well known in the art such as printed circuit techniques. Conductive pattern 40a is arranged to have a plurality of concentric tracks, each of which is engaged by a respective sliding contact brush and a common track also engaged by a sliding contact brush through which operating potential is applied to conductive pattern 40a. These brushes are best illustrated in FIG. 10 wherein each is referenced by the respective reference numeral 1A, 2A, 3A, 4A, 5A, 6A and 7A. In FIG. 10, brush 7A is illustrated as being in sliding electrical contact with the common concentric track of conductive pattern 40a and each of the other brushes is in sliding contact with a respective other concentric track of conductive pattern 40a, and each corresponds to a respective bit position of a digital signal representation. Brush 7A may be connected to a source of direct current electrical power, such as an automotive type battery, and each of brushes 1A, 2A, 3A, 4A, 5A and 6A is connected to a point of reference or ground potential through a respective resistor. As a consequence, when any one or more of these brushes is in electrical contact with a conductive portion of conductive pattern A, a digital signal appears across the corresponding resistor and point of reference or ground potential and is applied as a digital input signal to an associated microprocessor unit as is well known in the art. Conductive pattern 40a is so arranged that, as rotor 50 is rotated, only one bit of the digital signal representation changes at a time. As a consequence, the output signals from these brushes are not true binary numbers but, rather, are digital signal representations of respective switch operating positions. One example of a code of this type is the familiar gray code well known in the art. As a consequence, as rotor 50 is rotated, a series of digital signal representations of switch operating positions are applied as input signals to the associated microprocessor and are employed thereby in a manner to be later explained in this specification. As there are forty-eight switch operating positions with the embodiments herein described, a six bit digital signal representation is required to have a unique digital signal representation for each switch position. With more or less switch operating positions, digital signal representations of the switch operating positions may require more or less bits, as required.

An example of one application of the remote control unit of this invention is to perform the power switching functions of an automotive vehicle. Either embodiment described herein may be mounted remote from the passenger compartment such as in the engine compartment and may be controlled by a microprocessor unit such as the Motorola MC6802 marketed by Motorola Semiconductor Products, Inc. of Phoenix, Ariz. Located in the passenger compartment may be a plurality of function select switches, each of which may be of the momentary contact type having an output lead that normally has a logic signal of a selected level thereon while the switch is not operated that changes potential level to another selected logic signal upon the operation thereof. Each of these function select switches is arranged to produce, when operated, a change in potential level in the logic signal present upon the output lead thereof. The logic signals appearing upon the function select switch output circuit leads are employed as input signals to the microprocessor unit that is arranged to read or sense these output circuit leads through a multiplexer arrangement. The rate of scan of these output circuit leads is of the order of approximately five milliseconds.

In both embodiments of the remote control unit disclosed in this specification, there are twenty-four individual electrical load switches and forty-eight angular or switch operating positions of rotor 50. A memory device such as a register circuit having an address or bit position corresponding to each load switch is provided for storing in each address or bit position a logic signal indicative of the actual switch operating condition of the corresponding load switch and another memory device such as a register circuit having an address or bit position corresponding to each load switch is provided for storing in each address or bit position a logic signal indicative of the desired switch operating condition of the corresponding load switch.

In a manner well known in the microprocessor programming art, the microprocessor unit is preprogrammed to:

1. continuously scan the function select switch output circuit leads at a rate of the order of approximately five milliseconds;

2. detect a change of potential level upon any of the function select switch output circuit leads from one level to another level indicating that a switching function has been selected;

3. to sense, upon the detection of a change of potential level, the logic signal contained in the address(es) of the actual switch operating condition memory device of the corresponding selected load switch(es) and to place the opposite logic signal indicative of the other switch operating condition in the address(es) of the desired switch operating condition memory device of the corresponding selected load switch(es);

4. to scan the desired and actual switch operating condition memory devices for a discrepancy between the actual and desired switch operating condition logic indicating signals at any corresponding address;

5. to double the number assigned to the load switch to which the address of the actual and desired switch operating condition memory devices at which a discrepancy is detected corresponds;

6. to sense the logic signal present in this address in the actual switch operating condition memory device and to add one to the number obtained in step 5 if the function is to be a selected switch operating condition and to leave this number the same if the function is to be the other switch operating condition;

7. to determine and store the desired switch operating position in which the rotor of the remote control unit must be positioned to perform the desired switching function by sensing the binary number stored in the address of a first lookup table corresponding to the number obtained in step 6 in which the binary number of the switch operating position in which the rotor must be positioned to effect the desired switching function is stored;

8. to energize two step motor windings;

9. to sense the digital signal representation of rotor position as produced by the code wheel attached to the rotor;

10. to determine the switch operating position in which the rotor is positioned by sensing the binary number stored in the address of another second lookup table corresponding to the digital signal representation of switch operating position produced by the code wheel in which the binary number of the switch operating position corresponding to this digital signal representation is stored;

11. to determine the required number of steps and the direction of rotation required to reposition the rotor through the shortest number of steps in the switch operating position in which it must be positioned to effect the desired switching function by subtracting the switch operating position to which the rotor must be repositioned from the switch operating position in which the rotor is aligned and repositioning the rotor as follows:

a. if the difference is a negative number of an absolute value of twenty-four or less, the motor is stepped in a clockwise direction by a number of steps equal to the absolute value of the difference;

b. if the difference is a negative number with an absolute value greater than twenty-four, the absolute value of the difference is subtracted from forty-eight and the motor is stepped in a counterclockwise direction by a number of steps equal to this difference;

c. if the difference is a positive number of a value of twenty-four or less, the motor is stepped in a counterclockwise direction by a number of steps equal to the difference; and d. if the difference is a positive number greater than twenty-four, the value of the difference is subtracted from forty-eight and the motor is stepped in a clockwise direction by a number of steps equal to this difference;

12. to determine after the repositioning operation whether or not the rotor is positioned in the desired switch operating position to perform the desired switching function by sensing the binary number stored in the address of the second lookup table corresponding to the digital signal representation of switch operating position produced by the code wheel in which the binary number of the switch operating position corresponding to this digital signal representation is stored and comparing the binary number stored in this address with the binary number of the desired switch operating position;

13. to repeat steps 1–12 if the binary numbers are not the same or to energize the solenoid coil if the two compared numbers do agree and to place the logic signal indicative of the actual switch operating condition in the address of the actual switch operating condition memory device corresponding to the load switch required to perform the function.

For purposes of this specification, it will be assumed that each of the output leads of the momentary contact function select switches normally has a "High" electrical signal thereon through a pull up resistor to a direct current potential source such as the automobile battery; that upon the operation of any one of the function select switches, a "low" electrical signal is present upon the corresponding output lead; that the logic signal indicative of an "on" function is a logic 1; that the logic signal indicative of an "off" function is a logic 0; that it is desired to turn the vehicle parking lights on; that load switch 17 of FIG. 9 is the load switch selected to control the parking light switching functions; that rotor 50 is in switch operating position 2 as indicated by FIG. 9; that the operation of operating tab 17*a* of load switch 17 must be operated toward rotor 50 for the "on" function; and that all of the load switches are in the "off" operating condition with a logic 0 in each of the addresses or bit positions of the actual and desired switch operating condition memory devices.

Should it be desired to turn the parking lights "on", the corresponding function select switch located in the passenger compartment is operated to place a logic 0 upon the corresponding output lead thereof. When the microprocessor detects this change of potential level indicating that a switching function has been selected, the logic signal contained in the address of the actual switch operating condition memory device corresponding to load switch 17 is detected. Since the logic signal contained in this address is a logic 0, a logic 1 signal is placed in the corresponding address of the desired switch operating condition memory device corresponding to load switch 17. When this discrepancy between the logic signals present in the addresses of the actual and desired switch operating condition memory devices corresponding to load switch 17 is detected, the number 17 is doubled to thirty-four and, since an "on" function is desired, one is added to this number to make it thirty-five. The binary number of the switch operating position number thirty-three in which the rotor 50 must be positioned to effect the desired "on" switching function is sensed in address number thirty-five of the first lookup table. Step motor 60 is then energized to align rotor 50 in the position as determined by the magnetic field produced by the energized windings and the digital signal representation of rotor position as produced by the code wheel attached to rotor 50 is sensed. The binary number of the switch operating position in which the rotor is positioned is sensed in the address corresponding to the digital signal representation produced by the code wheel in the second lookup table which, for purposes of this specification, will be assumed to be switch operating position number two as shown in FIG. 9. Since rotor 50 is positioned in switch operating position number two, the desired switch operating position thrity-three is subtracted from the actual switch operating position number two to produce a difference of minus thirty-one. As this is a negative number with an absolute value greater than twenty-four, the absolute value thereof, thirty-one, is subtracted from forty-eight to obtain a difference of seventeen. Consequently, rotor 50 is stepped in a counterclockwise direction through seventeen steps or switch operating positions to switch operating position number thirty-three in which end 3*a* of actuator arm 3 is in register with operating tab 17*a* of switch 17. The digital signal representation as produced by code wheel 40 is again sensed and the binary number contained in the address of the second lookup table corresponding to this digital signal representation is sensed. If there is agreement between this sensed binary number and the binary number of the desired switch operating position, solenoid 75 is energized to tilt arm 3 in a clockwise direction about the pivot point to effect the operation of operating tab 17*a* of load switch 17 substantially in the direction of central axis A toward rotor 50 to effect the "on" switch function for load switch 19 to energize the parking lights. Upon the operation of solenoid 75, a logic 1 signal indicating the parking lights are "on" is placed in the address or bit position of the actual switch operating condition memory device corresponding to load switch 17.

Should it be desired to turn the parking lights "off", the corresponding function select switch located in the passenger compartment is operated to place a logic 0 upon the corresponding output lead thereof. When the microprocessor detects this change of potential level indicating that a switching function has been selected, the logic signal contained in the address of the actual switch operating condition memory device corresponding to load switch 17 is detected. Since the logic signal contained in this address is a logic 1 as the parking lights are on, a logic 0 signal is placed in the corresponding address of the desired switch operating condition memory device corresponding to load switch 17. When this discrepancy between the logic signals present in the addresses of the actual and desired switch operating condition memory devices corresponding to load switch 17 is detected, the number 17 is doubled to thirty-four and, since an "off" function is desired, this number is left at thirty-four. The binary number of the switch operating position number ten in which the rotor 50 must be positioned to effect the desired "off" switching function is sensed in address number thirty-four on the first lookup table. Step motor 60 is then energized to align rotor 50 in the position as determined by the magnetic field produced by the energized windings and the digital signal representation of rotor position as produced by the code wheel attached to rotor 52 is sensed. The binary number of the switch operating position in which the rotor is positioned is sensed in the address corresponding to the digital signal representation produced by the code wheel in the second lookup table which, for purposes of this specification, will be assumed to be again switch operating position number two. Since rotor 50 is positioned in switch operating position number two, the desired switch operation position ten is subtracted from the actual switch operating position number two to produce a difference of minus eight. As this is a negative number with an absolute value less than twenty-four, rotor 50 is stepped in a clockwise direction a number of steps equal to the absolute value of this difference or eight steps to switch operating position number ten in which end 3*b* of actuator arm 3 is in register with operating tab 17*a* of switch 17. The digital signal representation as produced by code wheel 40 is again sensed and the binary number contained in the address of the second lookup table corresponding to this digital signal representation is sensed. If there is agreement between this sensed binary number and the binary number of the desired switch operating position, solenoid 75 is energized to tilt arm 3 in a clockwise direction about the pivot point to effect the operation of operating tab 17*a* of load switch 17 substantially in the direction of central axis A away from rotor 50 to effect the "off" switch function for load switch 17 to deenergize the parking lights. Upon the operation of solenoid 75, a logic 0 signal indicating the parking lights are "off" is placed in the address or bit position of the actual switch operating condition memory device corresponding to load switch 17.

From this description, it is apparent that a system is disclosed wherein a plurality of electrical load switches may be centrally operated by a single centrally mounted unit including a single switch actuator mechanism that may be selectively controlled by a microprocessor unit.

Although the remote control unit of this invention is described on the basis of sliding contact type load switches, it is to be specifically understood that other type load switches may be employed without departing from the spirit of the invention. For example, snap-action switches, latching type switches or push-button type load switches may be employed. Further, tab actuated valves may also be employed and may be intermixed with electrical switches if so desired.

The system herein described is disclosed and described with reference to a microprocessor program flow chart in copending U.S. patent application Ser. No. 289,464, filed on Aug. 3, 1981 that is assigned to the same assignee as is this invention. Additionally, certain portions of the remote control unit disclosed and described in this application are disclosed and described in greater detail in another copending U.S. patent application Ser. No. 289,788, filed on Aug. 3, 1981 that is assigned to the same assignee as is this invention. The specification and drawing of these copending U.S. patent applications are specifically incorporated by reference in this application.

While two preferred embodiments of the remote control unit of this invention have been shown and described, it would be obvious to one skilled in the art that various modifications and substitutions may be made without departing from the spirit of the invention that is to be limited only within the scope of the appended claims.

The embodiments of the invention in which an exclusive property or privilege is claimed are defined as follows:

1. A remote control unit comprising:

a plurality of individual switches each having an operating tab extending toward a central axis to define a circle substantially normal to and concentric with said central axis, each said operating tab being movable in substantially the direction of said central axis between a common pair of planes substantially normal to said central axis to establish, respectively, one circuit condition or another circuit condition of the corresponding said switch;

a rotor supported for rotation substantially about said central axis in a plane substantially normal to said central axis and carrying an arm that extends across the diameter of said circle in radially overlapping relation to said tabs, said arm being tiltable about an axis substantially normal to said central axis and inboard of said circle and having ends circumferentially offset from each other so that said ends of said arm registers with each said tab at two angular positions of said rotor;

means for tilting said arm to a position out of engagement with said tabs in advance of rotor rotation, means for rotating said rotor to a position wherein an end of said arm registers with respective ones of said tabs and means for tilting said arm in an opposite direction to cause an end of the arm to engage and move a tab.

2. A remote control unit comprising:

a plurality of individual switches each having an operating tab extending toward a central axis to define a circle substantially normal to and concentric with said central axis, each said operating tab being movable in substantially the direction of said central axis between a common pair of planes substantially normal to said central axis to establish, respectively, one circuit condition or another circuit condition of the corresponding said switch;

a rotor supported for rotation substantially about said central axis in a plane substantially normal to said central axis and carrying an arm that has ends that overlap said operating tabs and normally lie in respective planes substantially parallel to and in bracketing relationship with said common pair of planes, said arm being tiltable about an axis substantially normal to said central axis and inboard of said circle and said ends being arranged to be brought into register with each of said operating tabs at mutually exclusive angular positions;

means selectively operable to position said rotor in a plurality of angular positions in each of which one of said ends of said arm is in register with a selected one of said operating tabs; and means for tilting said arm in a direction to operatively engage the said operating tab with which one of said ends thereof is in register to operate the corresponding said switch.

3. A remote control unit comprising:

a plurality of individual switches each having an operating tab extending toward a central axis whereby said operating tabs define a circle substantially normal to and concentric with said central axis, each said operating tab being movable in two directions substantially in the direction of said central axis between two planes substantially normal to said central axis to establish, respectively, one circuit condition or another circuit condition of the corresponding said switch;

a rotor supported for rotation substantially about said central axis in a plane substantially normal to said central axis;

means selectively operable to position said rotor in selected ones of a plurality of angular positions;

an arm tiltably mounted upon said rotor about an axis substantially normal to said central axis and inboard of said circle that is tilted in a first direction in advance of rotor rotation, said arm having opposite ends thereof that overlap said operating tabs and are so arranged that one of said ends is in register with a said operating tab in each of alternate ones of said angular positions and the other one of said ends is in register with a said operating tab in each of the other alternate ones of said angular positions; and means for tilting said arm in a second direction, when one of said ends of said arm is in register with a said operating tab to operatively engage the said operating tab with which the said one of said ends of said arm is in register to operate the corresponding said switch.

4. A remote control unit comprising:

a plurality of individual switches each having an operating tab extending toward a central axis whereby said operating tabs define a circle substantially normal to and concentric with said central axis, each said operating tab being movable substantially in the direction of said central axis between a common pair of planes substantially normal to said central axis to establish, respectively, one circuit condition or another circuit condition of the corresponding said switch;

a rotor supported for rotation substantially about said central axis in a plane substantially normal to said central axis and carrying an arm that extends across the diameter of said circle, said arm being tiltable about an axis substantially normal to said central axis and inboard of said circle and having ends that are in overlapping relationship with and are arranged to be brought into register with each of said operating tabs at mutually exclusive angular positions;

means selectively operable to position said rotor in selected ones of a plurality of angular positions in each of which one of said ends of said arm is in register with one of said operating tabs;

means to tilt said arm in a first direction to a first position at which said ends of said arm are on the operating side of said tabs; and means for tilting said arm in a second direction when one of said ends of said arm is in register with a switch operating tab to operatively engage the said operating tab with which the said one of said arm is in register to operate the corresponding said switch.

5. A remote control unit comprising:

a plurality of circumferentially arranged individual switches each having an operating tab that is operable in two opposite directions for establishing, respectively, one circuit condition or another circuit condition for the corresponding said switch, said operating tabs extending toward a central axis whereby said operating tabs define a circle substantially normal to and concentric with said central axis;

a rotor supported for rotation substantially about said central axis in a plane substantially normal to said central axis;

means selectively operable for rotating said rotor in either direction through a succession of discrete angular positions of a number equal to twice the number of said individual switches;

an arm tiltably mounted upon said rotor about an axis substantially normal to said central axis and inboard of said circle that is spring force tilted in a first direction about said axis, said arm having a switch operating projection on each opposite side of said axis that are so arranged that one of said projections is in register with a said operating tab in each of alternate ones of said switch operating positions and the other one of said projections is in register with a said operating tab in each of the other alternate ones of said switch operating positions; and means for tilting said arm in a second direction against said spring force when one of said projections is in register with a said operating tab to operatively engage the same operating tab with which the said one of said ends of said arm is in register to operate the corresponding said switch.

6. A remote control unit comprising:

a plurality of circumferentially arranged individual switches each having an operating tab that is operable in two opposite directions for establishing, respectively, one circuit condition or another circuit condition for the corresponding said switch, said operating tabs extending toward a central axis whereby said operating tabs define a circle substantially normal to and concentric with said central axis;

a rotor supported for rotation substantially about said central axis in a plane substantially normal to said central axis;

means selectively operable for rotating said rotor in either direction through a succession of discrete angular positions of a number equal to twice the number of said individual switches;

an arm tiltably mounted upon said rotor about an axis substantially normal to said central axis and inboard of said circle that is spring force tilted in a first direction about said axis, said arm having a switch operating projection on each opposite side of said axis that are so arranged that one of said projections is in register with a said operating tab in each of alternate ones of said switch operating positions and the other one of said projections is in register with a said operating tab in each of the other alternate ones of said switch operating positions;

means for tilting said arm in a second direction against said spring force when one of said projections is in register with a said operating tab to operate the corresponding said switch; and means carried by said rotor for producing a different electrical code signal for each of said switch operating positions.

7. A remote control unit comprising:

a plurality of individual switches each having operating tab means disposed about a central axis to define a circle substantially normal to and concentric with said central axis, each said operating tab means being movable in substantially the direction of said central axis between a common pair of planes substantially normal to said central axis to establish, respectively, one circuit condition or another circuit condition of the corresponding said switch;

a rotor supported for rotation substantially about said central axis in a plane substantially normal to said central axis and carrying an arm that extends across into said circle in radially overlapping relation to said tab means, said arm being tiltable about an axis substantially normal to said central axis and inboard of said circle and having ends circumferentially offset from each other so that said arm registers with each said tab means at two angular positions; of said rotor means selectively operable to position said rotor with an end of said arm in register with a selected said tab means; and means for tilting said arm into engagement with a tab means to thereby shift the tab means to operate a switch.

8. A remote control unit comprising:

a plurality of individual electrical switches supported such that they are located in a substantially circular array, each switch having a switch actuator that can be shifted between two positions corresponding to two different circuit conditions of a switch, a rotor supported for rotation, an arm pivoted to said rotor having first and second spaced abutment means positioned to engage and shift a switch actuator by pivotal movement of said arm relative to said rotor, the actuators of the switches and the abutment means being so relatively positioned that in one rotative position of the rotor pivotal movement of said arm causes said first abutment means to engage a switch actuator to shift it in one direction and in another rotative position of the rotor pivotal movement of said arm causes said second abutment means to engage the same switch actuator to shift it in an opposite direction, means for rotatably positioning said rotor, and means for pivoting said arm relative to said rotor when the rotor has been located in a position such that an abutment means can engage a switch actuator.

* * * * *